US009835018B2

(12) United States Patent
Krish et al.

(10) Patent No.: US 9,835,018 B2
(45) Date of Patent: Dec. 5, 2017

(54) ROTARY ISOBARIC PRESSURE EXCHANGER SYSTEM WITH LUBRICATION SYSTEM

(71) Applicant: Energy Recovery, Inc., San Leandro, CA (US)

(72) Inventors: Prem Krish, Foster City, CA (US); Farshad Ghasripoor, Berkeley, CA (US); Jeremy Grant Martin, Oakland, CA (US)

(73) Assignee: Energy Recovery, Inc., San Leandro, CA (US)

( * ) Notice: Subject to any disclaimer, the term of this patent is extended or adjusted under 35 U.S.C. 154(b) by 233 days.

(21) Appl. No.: 14/586,545

(22) Filed: Dec. 30, 2014

(65) Prior Publication Data

US 2015/0184502 A1 Jul. 2, 2015

Related U.S. Application Data

(60) Provisional application No. 61/922,598, filed on Dec. 31, 2013, provisional application No. 61/922,442, filed on Dec. 31, 2013.

(51) Int. Cl.
*E21B 43/26* (2006.01)
*F04F 13/00* (2009.01)

(52) U.S. Cl.
CPC ..... *E21B 43/26* (2013.01); *F04F 13/00* (2013.01)

(58) Field of Classification Search
None
See application file for complete search history.

(56) References Cited

U.S. PATENT DOCUMENTS

| | | | | |
|---|---|---|---|---|
| 3,560,053 | A * | 2/1971 | Ortloff | E21B 43/267 406/109 |
| 4,363,518 | A | 12/1982 | Nakamura et al. | |
| 4,887,942 | A * | 12/1989 | Hauge | F15B 3/00 417/64 |
| 6,523,347 | B1 * | 2/2003 | Jirnov | F01C 1/3442 60/651 |
| 6,540,487 | B2 * | 4/2003 | Polizos | F04B 1/2042 210/652 |
| 7,845,413 | B2 * | 12/2010 | Shampine | E21B 43/267 166/105 |
| 2002/0148645 | A1 * | 10/2002 | Falgout, Sr. | E21B 21/103 175/40 |
| 2007/0137170 | A1 | 6/2007 | Bross et al. | |
| 2009/0047153 | A1 * | 2/2009 | Best | E21B 43/126 417/415 |

(Continued)

FOREIGN PATENT DOCUMENTS

| | | |
|---|---|---|
| GB | 2065232 A | 6/1981 |
| WO | 9617176 A1 | 6/1996 |

OTHER PUBLICATIONS

Examination Report issued in counterpart Australian Patent Application No. 2014373731 dated Nov. 1, 2016 (4 pages).

(Continued)

*Primary Examiner* — Shane Bomar
(74) *Attorney, Agent, or Firm* — Fletcher Yoder, P.C.

(57) ABSTRACT

A system including a frac system with a rotary isobaric pressure exchanger configured to exchange pressures between a first fluid and a second fluid, and a lubrication system configured to lubricate the rotary isobaric pressure exchanger.

15 Claims, 6 Drawing Sheets

(56) References Cited

U.S. PATENT DOCUMENTS

| | | | | |
|---|---|---|---|---|
| 2009/0180903 | A1* | 7/2009 | Martin | F04F 13/00 417/405 |
| 2010/0196152 | A1* | 8/2010 | Pique | B01D 61/06 415/208.1 |
| 2011/0008182 | A1* | 1/2011 | Krogsgard | F04F 13/00 417/63 |
| 2011/0058966 | A1* | 3/2011 | Cunningham | F04D 13/10 417/410.1 |
| 2011/0176936 | A1* | 7/2011 | Andrews | F04B 7/0023 417/64 |
| 2012/0067825 | A1* | 3/2012 | Pique | E21F 3/00 210/723 |
| 2012/0217011 | A1* | 8/2012 | Dotson | E21B 43/114 166/305.1 |

OTHER PUBLICATIONS

Invitation to Pay Additional Fees and Results of the Partial International Search dated May 4, 2015.
Australian Office Action for AU Application No. 2014373731 dated Feb. 16, 2017; 6 pgs.

* cited by examiner 40
42
44
46
48
50
52
54
56
58
60
62
64
66
68
70
72
74
76
78
80
82
84
86
88
90

ROTARY ISOBARIC PRESSURE EXCHANGER SYSTEM WITH LUBRICATION SYSTEM

CROSS REFERENCE TO RELATED APPLICATIONS

This application claims priority to and benefit of U.S. Provisional Patent Application No. 61/922,598, entitled "Rotary Isobaric Pressure Exchanger System with Flush System," filed Dec. 31, 2013, and U.S. Provisional Patent Application No. 61/922,442, entitled "Rotary Isobaric Pressure Exchanger System with Lubrication," filed Dec. 31, 2013, which are herein incorporated by reference in their entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Well completion operations in the oil and gas industry often involve hydraulic fracturing (often referred to as fracking or fracing) to increase the release of oil and gas in rock formations. Hydraulic fracturing involves pumping a fluid (e.g., frac fluid) containing a combination of water, chemicals, and proppant (e.g., sand, ceramics) into a well at high pressures. The high pressures of the fluid increases crack size and crack propagation through the rock formation releasing more oil and gas, while the proppant prevents the cracks from closing once the fluid is depressurized. Fracturing operations use high-pressure pumps to increase the pressure of the frac fluid. Unfortunately, the proppant in the frac fluid may interfere with the operation of the rotating equipment. In certain circumstances, the solids may prevent the rotating components from rotating and/or cause wear when they enter gaps between rotating and non-rotating equipment.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
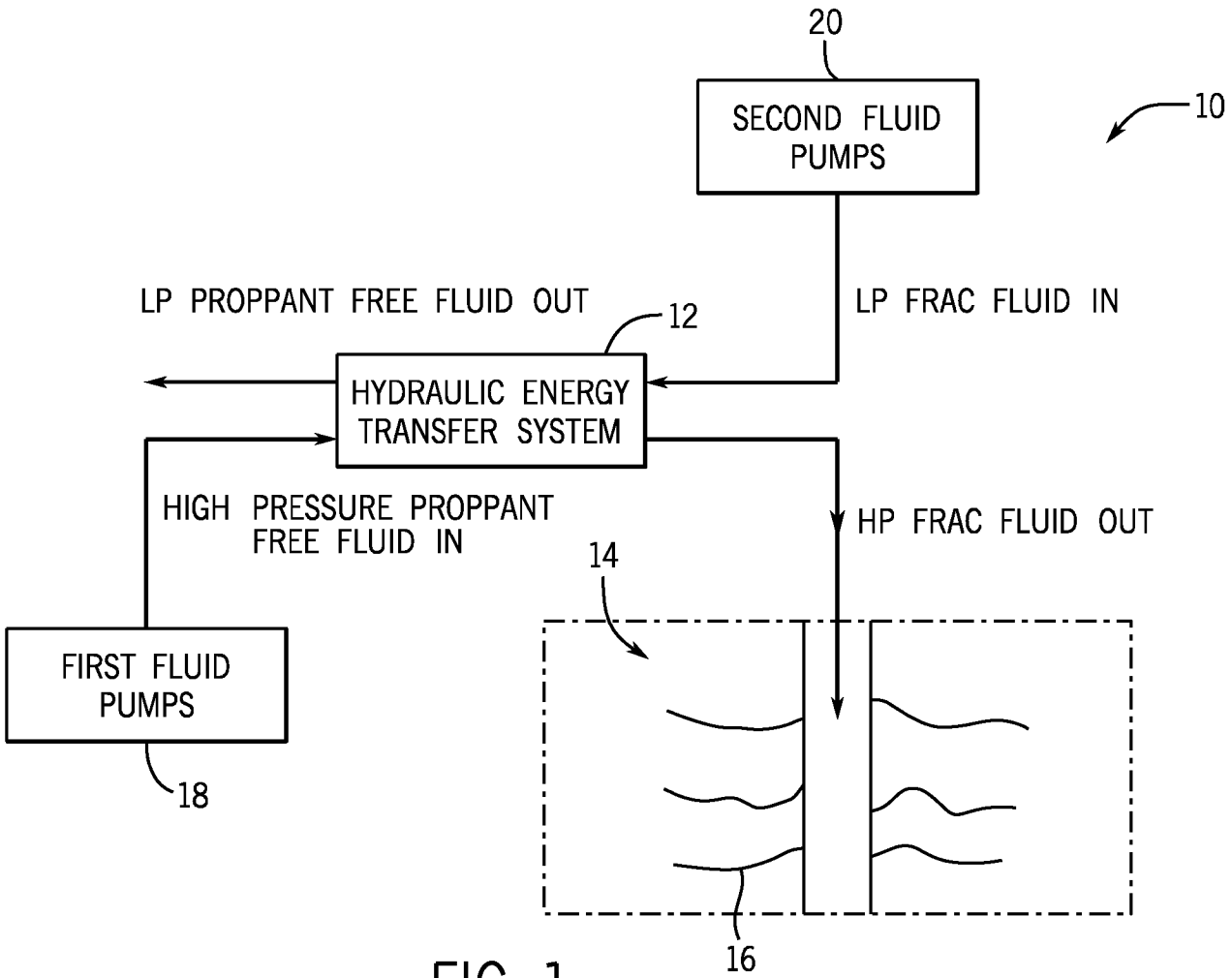
FIG. 1 is a schematic diagram of an embodiment of a frac system with a hydraulic energy transfer system.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed in detail below, the frac system or hydraulic fracturing system includes a hydraulic energy transfer system that transfers work and/or pressure between a first fluid (e.g., a pressure exchange fluid, such as a substantially proppant free fluid) and a second fluid (e.g., frac fluid, such as a proppant-laden fluid). For example, the first fluid may be at a first pressure between approximately 5,000 kPa to 25,000 kPa, 20,000 kPa to 50,000 kPa, 40,000 kPa to 75,000 kPa, 75,000 kPa to 100,000 kPa or greater than the second pressure of the second fluid. In operation, the hydraulic energy transfer system may or may not completely equalize pressures between the first and second fluids. Accordingly, the hydraulic energy transfer system may operate isobarically, or substantially isobarically (e.g., wherein the pressures of the first and second fluids equalize within approximately +/−1, 2, 3, 4, 5, 6, 7, 8, 9, or 10 percent of each other).

The hydraulic energy transfer system may also be described as a hydraulic protection system, hydraulic buffer system, or a hydraulic isolation system, because it blocks or limits contact between a frac fluid and various hydraulic fracturing equipment (e.g., high-pressure pumps), while still exchanging work and/or pressure between the first and second fluids. By blocking or limiting contact between various pieces of hydraulic fracturing equipment and the second fluid (e.g., proppant containing fluid), the hydraulic energy transfer system reduces abrasion and wear, thus increasing the life and performance of this equipment (e.g., high-pressure pumps). Moreover, it may enable the frac system to use less expensive equipment in the fracturing system, for example, high-pressure pumps that are not designed for abrasive fluids (e.g., frac fluids and/or corrosive fluids). In some embodiments, the hydraulic energy transfer system may be a rotating isobaric pressure exchanger (e.g., rotary IPX). Rotating isobaric pressure exchangers may be generally defined as devices that transfer fluid pressure between a high-pressure inlet stream and a low-pressure inlet stream at efficiencies in excess of approximately 50%, 60%, 70%, 80%, or 90% without utilizing centrifugal technology.

In operation, the hydraulic energy transfer system transfers work and/or pressure between first and second fluids. These fluids may be multi-phase fluids such as gas/liquid flows, gas/solid particulate flows, liquid/solid particulate flows, gas/liquid/solid particulate flows, or any other multi-phase flow. For example, the multi-phase fluids may include sand, solid particles, powders, debris, ceramics, or any combination therefore. These fluids may also be non-Newtonian fluids (e.g., shear thinning fluid), highly viscous fluids, non-Newtonian fluids containing proppant, or highly viscous fluids containing proppant. To facilitate rotation the hydraulic energy transfer system may include a lubrication system and/or a flush system. For example, the hydraulic energy transfer system may include a lubrication system that provides fluid flow between rotating and stationary components to create a fluid bearing and/or to supplement a fluid bearing, facilitating operation of the hydraulic energy transfer system. In some embodiments, the hydraulic energy transfer system may include a flush system that removes and/or blocks the flow of particulate (e.g., proppant) into gaps between rotating and non-rotating components, (e.g., at a fluid bearing). For example, the flush system may remove particulate before operation, after operation, or during operation of the hydraulic energy transfer system to increase the efficiency of the hydraulic energy transfer system and to block the hydraulic energy transfer system from stalling. A fluid bearing is a bearing that supports a load on a layer (e.g., thin) of fluid.

FIG. 1 is a schematic diagram of an embodiment of the frac system 10 (e.g., fluid handling system) with a hydraulic energy transfer system 12. In operation, the frac system 10 enables well completion operations to increase the release of oil and gas in rock formations. The frac system 10 may include one or more first fluid pumps 18 and one or more second fluid pumps 20 coupled to a hydraulic energy transfer system 12. For example, the hydraulic energy system 12 may be rotary IPX. In addition, the hydraulic energy transfer system 12 may be disposed on a skid separate from the other components of a frac system 10, which may be desirable in situations in which the hydraulic energy transfer system 12 is added to an existing frac system 10. In operation, the hydraulic energy transfer system 12 transfers pressures without any substantial mixing between a first fluid (e.g., proppant free fluid) pumped by the first fluid pumps 18 and a second fluid (e.g., proppant containing fluid or frac fluid) pumped by the second fluid pumps 20. In this manner, the hydraulic energy transfer system 12 blocks or limits wear on the first fluid pumps 18 (e.g., high-pressure pumps), while enabling the frac system 10 to pump a high-pressure frac fluid into the well 14 to release oil and gas. In addition, because the hydraulic energy transfer system 12 is configured to be exposed to the first and second fluids, the hydraulic energy transfer system 12 may be made from materials resistant to corrosive and abrasive substances in either the first and second fluids. For example, the hydraulic energy transfer system 12 may be made out of ceramics (e.g., alumina, cermets, such as carbide, oxide, nitride, or boride hard phases) within a metal matrix (e.g., Co, Cr or Ni or any combination thereof) such as tungsten carbide in a matrix of CoCr, Ni, NiCr or Co.

Figure 2:
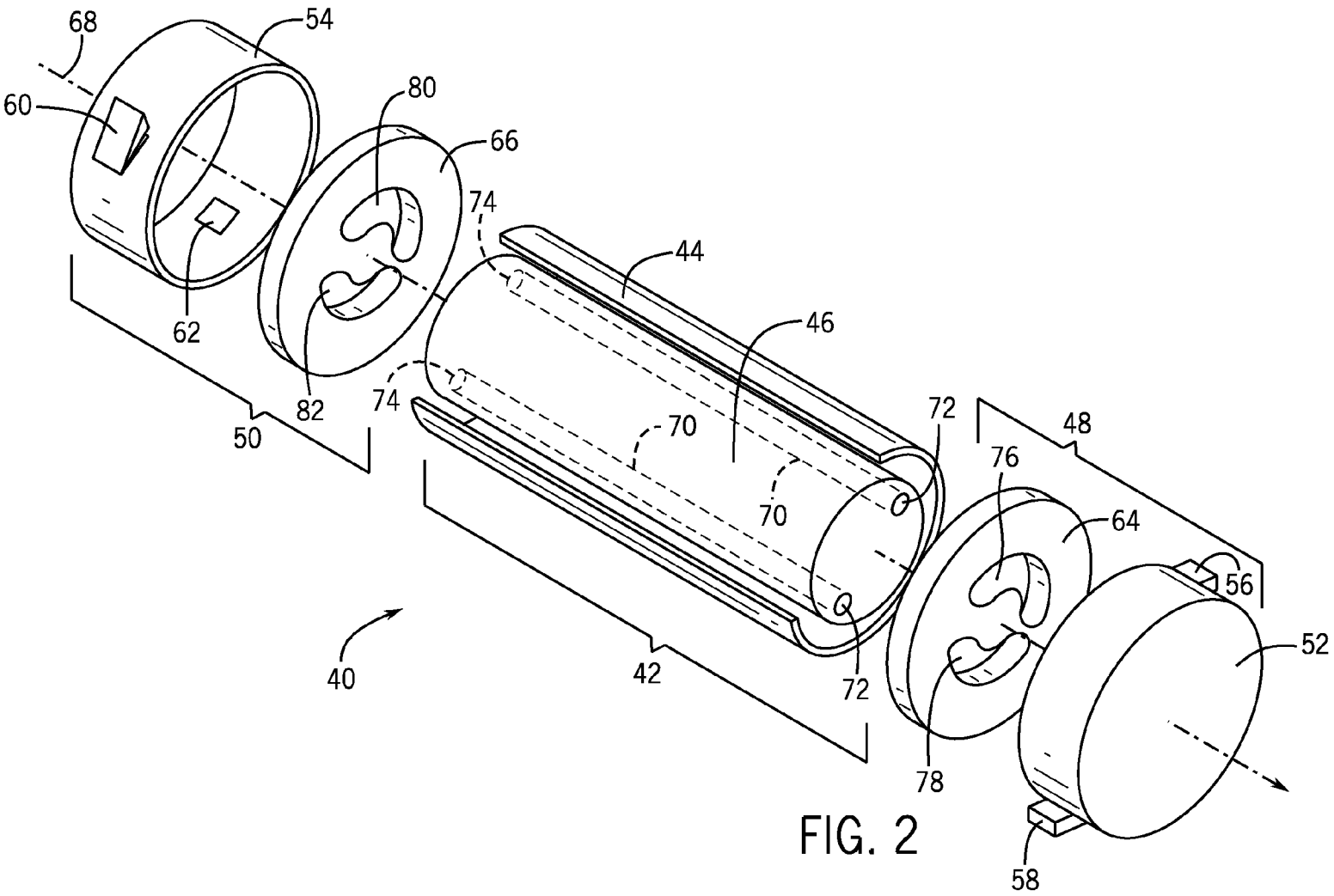
FIG. 2 is an exploded perspective view of an embodiment of a rotary isobaric pressure exchanger (rotary IPX)

FIG. 2 is an exploded perspective view of an embodiment of a rotary isobaric pressure exchanger 40 (rotary IPX) capable of transferring pressure and/or work between first and second fluids (e.g., proppant free fluid and proppant laden fluid) with minimal mixing of the fluids. The rotary IPX 40 may include a generally cylindrical body portion 42 that includes a sleeve 44 and a rotor 46. The rotary IPX 40 may also include two end caps 48 and 50 that include manifolds 52 and 54, respectively. Manifold 52 includes respective inlet and outlet ports 56 and 58, while manifold 54 includes respective inlet and outlet ports 60 and 62. In operation, these inlet ports 56, 60 enabling the first fluid (e.g., proppant free fluid) to enter the rotary IPX 40 to exchange pressure, while the outlet ports 60, 62 enable the first fluid to then exit the rotary IPX 40. In operation, the inlet port 56 may receive a high-pressure first fluid, and after exchanging pressure, the outlet port 58 may be used to route a low-pressure first fluid out of the rotary IPX 40. Similarly, the inlet port 60 may receive a low-pressure second fluid (e.g., proppant containing fluid, frac fluid) and the outlet port 62 may be used to route a high-pressure second fluid out of the rotary IPX 40. The end caps 48 and 50 include respective end covers 64 and 66 disposed within respective manifolds 52 and 54 that enable fluid sealing contact with the rotor 46. The rotor 46 may be cylindrical and disposed in the sleeve 44, which enables the rotor 46 to rotate about the axis 68. The rotor 46 may have a plurality of channels 70 extending substantially longitudinally through the rotor 46 with openings 72 and 74 at each end arranged symmetrically about the longitudinal axis 68. The openings 72 and 74 of the rotor 46 are arranged for hydraulic communication with inlet and outlet apertures 76 and 78; and 80 and 82 in the end covers 52 and 54, in such a manner that during rotation the channels 70 are exposed to fluid at high-pressure and fluid at low-pressure. As illustrated, the inlet and outlet apertures 76 and 78, and 78 and 80 may be designed in the form of arcs or segments of a circle (e.g., C-shaped).

In some embodiments, a controller using sensor feedback may control the extent of mixing between the first and second fluids in the rotary IPX 40, which may be used to improve the operability of the fluid handling system. For example, varying the proportions of the first and second fluids entering the rotary IPX 40 allows the plant operator to control the amount of fluid mixing within the hydraulic energy transfer system 12. Three characteristics of the rotary IPX 40 that affect mixing are: (1) the aspect ratio of the rotor channels 70, (2) the short duration of exposure between the first and second fluids, and (3) the creation of a fluid barrier (e.g., an interface) between the first and second fluids within the rotor channels 70. First, the rotor channels 70 are generally long and narrow, which stabilizes the flow within the rotary IPX 40. In addition, the first and second fluids may move through the channels 70 in a plug flow regime with minimal axial mixing. Second, in certain embodiments, the speed of the rotor 46 reduces contact between the first and second fluids. For example, the speed of the rotor 46 may reduce contact times between the first and second fluids to less than approximately 0.15 seconds, 0.10 seconds, or 0.05 seconds. Third, a small portion of the rotor channel 70 is used for the exchange of pressure between the first and second fluids. Therefore, a volume of fluid remains in the channel 70 as a barrier between the first and second fluids. All these mechanisms may limit mixing within the rotary IPX 40. Moreover, in some embodiments, the rotary IPX 40 may be designed to operate with internal pistons that isolate the first and second fluids while enabling pressure transfer.

FIGS. 3-6 are exploded views of an embodiment of the rotary IPX 40 illustrating the sequence of positions of a single channel 70 in the rotor 46 as the channel 70 rotates through a complete cycle. It is noted that FIGS. 3-6 are simplifications of the rotary IPX 40 showing one channel 70, and the channel 70 is shown as having a circular cross-sectional shape. In other embodiments, the rotary IPX 40 may include a plurality of channels 70 with the same or different cross-sectional shapes (e.g., circular, oval, square, rectangular, polygonal, etc.). Thus, FIGS. 3-6 are simplifications for purposes of illustration, and other embodiments of the rotary IPX 40 may have configurations different from that shown in FIGS. 3-6. As described in detail below, the rotary IPX 40 facilitates pressure exchange between first and second fluids (e.g., proppant free fluid and proppant-laden fluid) by enabling the first and second fluids to momentarily contact each other within the rotor 46. In certain embodiments, this exchange happens at speeds that result in limited mixing of the first and second fluids.

Figures 3, 4, 5, 6:
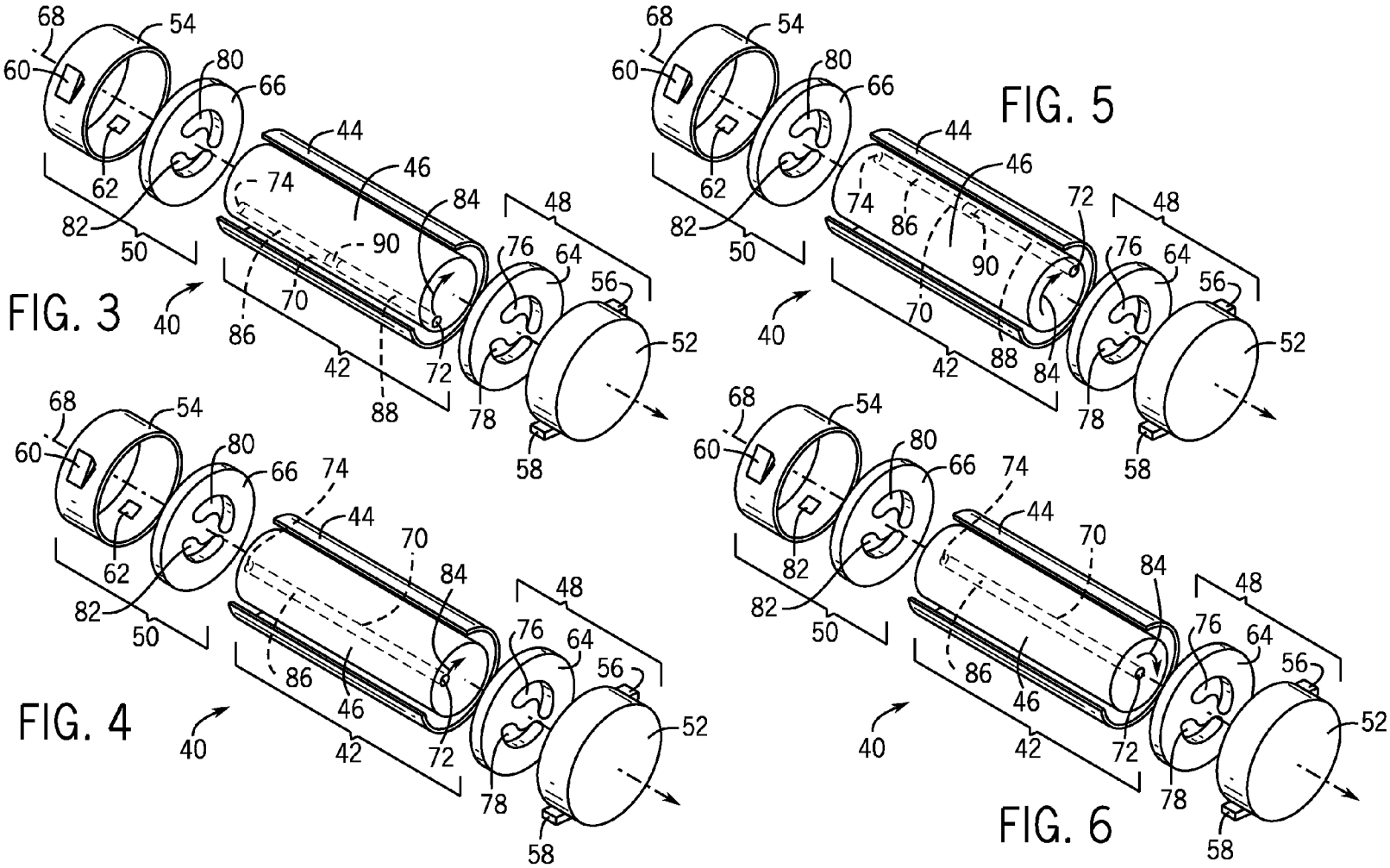
FIG. 3 is an exploded perspective view of an embodiment of a rotary IPX in a first operating position.
FIG. 4 is an exploded perspective view of an embodiment of a rotary IPX in a second operating position.
FIG. 5 is an exploded perspective view of an embodiment of a rotary IPX in a third operating position.
FIG. 6 is an exploded perspective view of an embodiment of a rotary IPX in a fourth operating position.

In FIG. 3, the channel opening 72 is in a first position. In the first position, the channel opening 72 is in fluid communication with the aperture 78 in endplate 64 and therefore with the manifold 52, while the opposing channel opening 74 is in hydraulic communication with the aperture 82 in end cover 66 and by extension with the manifold 54. As will be discussed below, the rotor 46 may rotate in the clockwise direction indicated by arrow 84. In operation, low-pressure second fluid 86 passes through end cover 66 and enters the channel 70, where it contacts the first fluid 88 at a dynamic fluid interface 90. The second fluid 86 then drives the first fluid 88 out of the channel 70, through end cover 64, and out of the rotary IPX 40. However, because of the short duration of contact, there is minimal mixing between the second fluid 86 and the first fluid 88.

In FIG. 4, the channel 70 has rotated clockwise through an arc of approximately 90 degrees. In this position, the outlet 74 is no longer in fluid communication with the apertures 80 and 82 of end cover 66, and the opening 72 is no longer in fluid communication with the apertures 76 and 78 of end cover 64. Accordingly, the low-pressure second fluid 86 is temporarily contained within the channel 70.

In FIG. 5, the channel 70 has rotated through approximately 60 degrees of arc from the position shown in FIG. 6. The opening 74 is now in fluid communication with aperture 80 in end cover 66, and the opening 72 of the channel 70 is now in fluid communication with aperture 76 of the end cover 64. In this position, high-pressure first fluid 88 enters and pressurizes the low-pressure second fluid 86 driving the second fluid 86 out of the fluid channel 70 and through the aperture 80 for use in the frac system 10.

In FIG. 6, the channel 70 has rotated through approximately 270 degrees of arc from the position shown in FIG. 6. In this position, the outlet 74 is no longer in fluid communication with the apertures 80 and 82 of end cover 66, and the opening 72 is no longer in fluid communication with the apertures 76 and 78 of end cover 64. Accordingly, the first fluid 88 is no longer pressurized and is temporarily contained within the channel 70 until the rotor 46 rotates another 90 degrees, starting the cycle over again.

Figure 7:
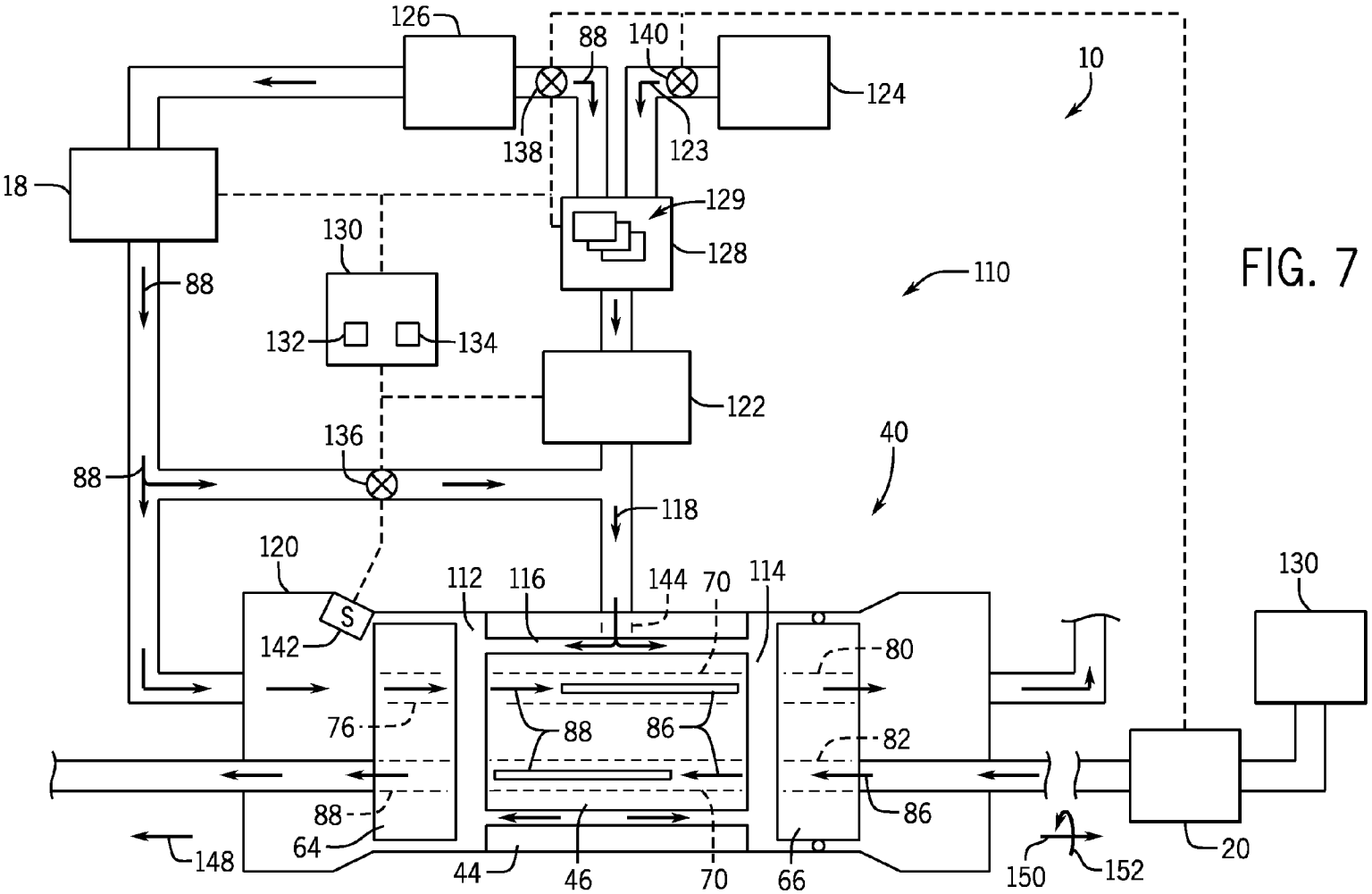
FIG. 7 is a cross-sectional view of an embodiment of a rotary IPX with a lubrication system.

FIG. 7 is a cross-sectional view of an embodiment of a frac system 10 with a lubrication system 110. As explained above, the frac system 10 may include a rotary IPX 40 that transfers pressures between the first fluid 88 and the second fluid 86 as the rotor 46 rotates within the sleeve 44. To facilitate rotation of the rotor 46, the rotary IPX 40 forms a fluid bearing with the first fluid 88 and/or second fluid 86 within a first gap 112 between the end cap 64 and the rotor 46; a second gap 114 (e.g., an axial gap in a radial plane) between the end cap 66 and the rotor 46; and in a third gap 116 (e.g., a radial gap or annular space) between the rotor 46 and the sleeve 44. Unfortunately, the rotary IPX 40 may be unable to direct/provide enough fluid to maintain the fluid bearings in the gaps 112, 114, and 116. Accordingly, the rotary IPX 40 includes the lubrication system 110, which may continuously pump a lubricating fluid 118 through an outer casing 120 (e.g., housing) of the rotary IPX 40 and into the gaps 112, 114, and 116.

As illustrated, the lubrication system 110 may include one or more high-pressure pumps 18, 122 that pump the lubricating fluid 118 into the rotary IPX 40. The lubricating fluid 118 may be a combination of fluid 123 from the fluid source 124 and/or first fluid 88 from a first fluid source 126. For example, a portion of the first fluid 88 may be diverted from the first fluid source 126 and into a fluid treatment system 128 and combined with the fluid 123 to form the lubricating fluid 118. Indeed, the fluid 123 (e.g., low friction fluid, etc.) may modify the viscosity, adjust the chemical composition, etc. of the first fluid 88 to form an appropriate lubricating fluid 88. In some embodiments, the fluid treatment system 128 may treat the first fluid 88, turning the first fluid 88 into the lubricating fluid 118. For example, the fluid treatment system 128 may treat or alter the first fluid 88 by filtering particulate (e.g., filter with one or more filters 129), modifying viscosity, adjusting the chemical composition, etc. In still other embodiments, the second fluid 86 may be diverted from the second fluid source 130 into the fluid treatment system 128 to convert the second fluid 86 into a lubricating fluid 118. Once formed, the lubricating fluid 118 may then be pumped into the rotary IPX 40 to form or supplement the liquid bearings in the gaps 112, 114, and 116.

To control operation of the lubrication system 110, the frac system 10 may include a controller 130 with a processor 132 and a memory 134 that stores instructions executable by the processor 132 for controlling various valves (e.g., electronic actuators that open and close the valves); the pump(s) 18, 20, and 122; and the fluid treatment system 128. Indeed, the controller 130 communicates with and controls valves 136, 138, and 140 enabling selective use of different fluids as the lubricating fluid. For example, the controller 130 may open valve 136 and close valves 138 and 140 in order to use only the first fluid 88 as the lubricating fluid 118. In another embodiment, the controller 130 may open valve 138 and 140 to combine the first fluid 88 with fluid 123 in the fluid source 124 (e.g., blend the fluids 88 and 123). For example, the lubrication system 128 may form the lubricating fluid 118 by filtering the first fluid 88 and then changing the chemical composition of the first fluid 88 with fluid 123 from the fluid source 124 (e.g., change viscosity, etc.). In another embodiment, the controller 130 may open all of the valves 136, 138, and 140 to form the lubricating fluid 118.

In addition to controlling the composition of the lubrication fluid, the controller 130 communicates with the pumps 18, 20, and 122 to ensure that the lubricating fluid 118 is pumped into the rotary IPX 140 at a pressure sufficient to form or maintain fluid bearings in the gaps 112, 114, and 116. For example, the controller 130 may communicate with a pressure sensor 142 within the casing 120. The controller 130 may use the pressure signal from the pressure sensor 142 to then control the pumps 18, 20, and 122, ensuring that the lubricating fluid 118 entering the rotary IPX 40 enters at a pressure equal to or greater than the pressure of the first fluid 88. When the pressure of the lubricating fluid 118 is equal to or greater than the pressure of the first fluid 88, the lubricating fluid 118 is capable of forming or supplementing the liquid bearing in the gaps 112, 114, and 116, while simultaneously blocking, or driving it out (e.g., positive flow out of gaps), the untreated first and second fluids 88, 86 from entering the gaps 112, 114, and 116. For example, the lubrication system 110 may pump the lubricating fluid 118 through aperture 144 in the casing 120 and sleeve 44. As illustrated, the aperture 144 enables the lubricating fluid 118 to enter the gap 116 and contact an exterior surface 146 of the rotor 46. As the lubricating fluid 118 contacts the rotor 46, the lubricating fluid 118 spreads over the exterior surface 146 flowing in axial directions 148, 150 as well as in circumferential direction 152 forming a fluid bearing on which the rotor 46 rotates. While one aperture 144 is shown, other embodiments may include additional apertures 144 (e.g., 1, 2, 3, 4, 5, or more) that enable lubricating fluid 118 to be pumped into the rotary IPX 40. These apertures 144 may also be at different positions on the casing 120 (e.g., radial positions, axial positions, circumferential positions, or a combination thereof).

Figure 8:
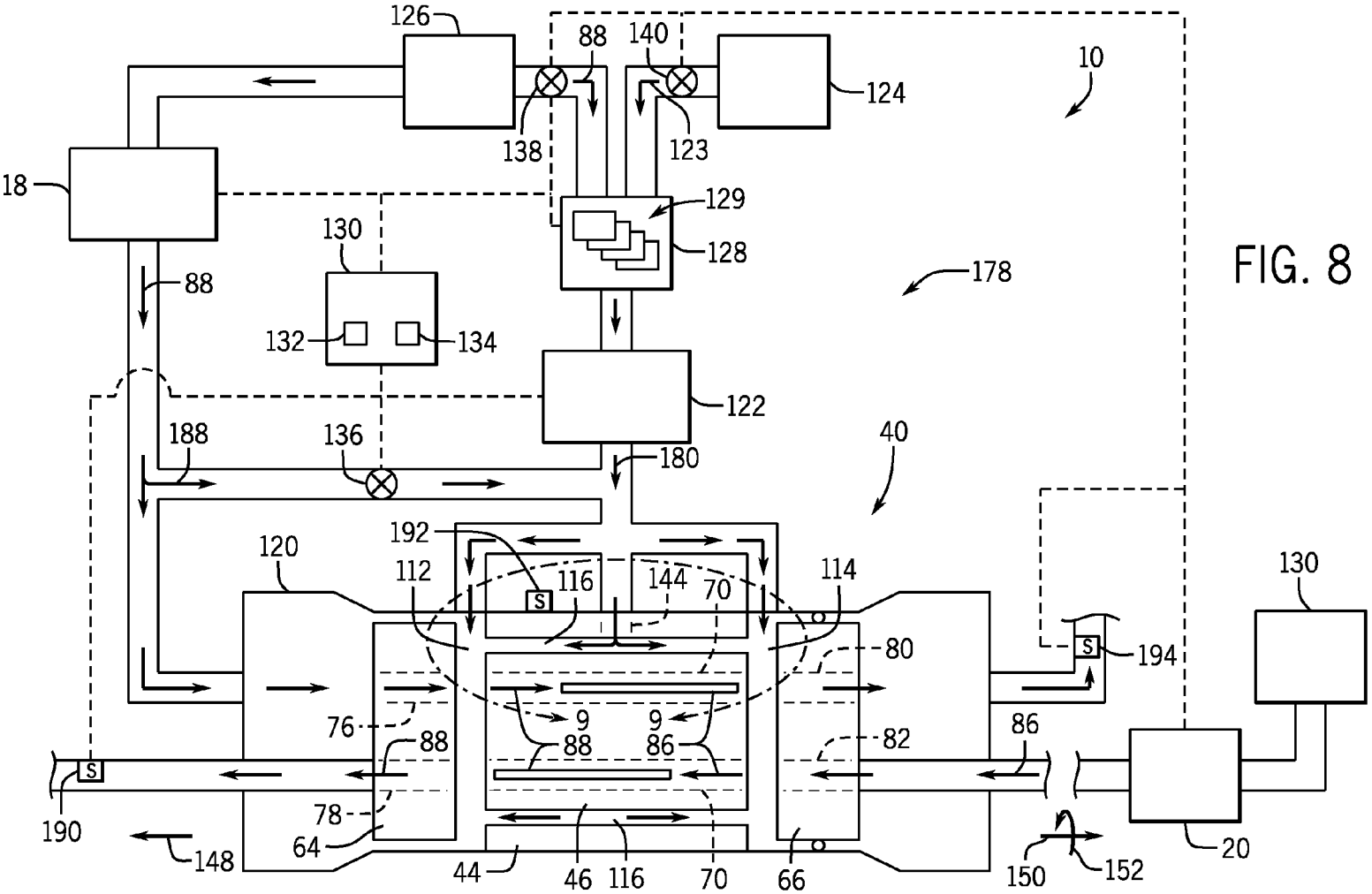
FIG. 8 is a cross-sectional view of an embodiment of a rotary IPX with a flush system.

FIG. 8 is a cross-sectional view of an embodiment of a frac system 10 with a flush system 178. As explained above, the frac system 10 may include a rotary IPX 40 that transfers pressures between the first fluid 88 and the second fluid 86 as the rotor 46 rotates within the sleeve 44. To facilitate rotation of the rotor 46 the rotary IPX 40 forms a fluid bearing with the first fluid 88 and/or second fluid 86 within a first gap 112 (e.g., axial gap) between the end cap 64 and the rotor 46; a second gap 114 (e.g., axial gap) between the end cap 66 and the rotor 46; and in a third gap 116 (e.g., radial gap) between the rotor 46 and the sleeve 44. Unfortunately, highly viscous and/or particulate laden fluid can potentially interfere with the operation of the rotor 46 in the rotary IPX 40. For example, the viscous or particulate laden fluids may enter into the gaps 112, 114, and 116, which may slow or stall the rotary IPX 40. Accordingly, the rotary IPX 40 includes the flush system 110, which may pump a flush fluid 180 through an outer casing 120 (e.g., housing) of the rotary IPX 40 and into the gaps 112, 114, and 116 to remove particulate, sediment, etc. It should be understood that some embodiments may combine the flush system 178 in FIG. 8 with the lubrication system 110 in FIG. 7, enabling the frac system 10 to both lubricate and flush the rotary IPX 40. The controller 130 in an embodiment that combines the flush system 178 and lubrication system 110 may include various modes to control the two systems (e.g., a lubricating mode, a flush mode, a cleaning mode, etc.). The different modes may be triggered in response to a preprogrammed schedule, sensor feedback, etc.

As illustrated, the flush system 178 may include one or more high-pressure pumps 18, 122 that pump the flush fluid 180 into the rotary IPX 40. The flush fluid 180 may be a combination of fluid 123 (e.g., detergent, solvent, low friction fluid, etc.) from the fluid source 124 (e.g., a fluid substantially free of particulate) and/or first fluid 88 from a first fluid source 126. For example, a portion of the first fluid 88 may be diverted from the first fluid source 126 and into a fluid treatment system 128 and combined with the fluid 123 to form the flush fluid 180. Indeed, the fluid 123 may modify the viscosity, adjust the chemical composition, etc. of the first fluid 88 to form an appropriate flush fluid 180. In some embodiments, the fluid treatment system 128 may treat the first fluid 88, turning the first fluid 88 into the flush fluid 180. For example, the fluid treatment system 128 may treat or alter the first fluid 88 by filtering particulate (e.g., filter with one or more filters 129), modifying viscosity, adjusting the chemical composition, etc. In still other embodiments, the second fluid 86 may be diverted from the second fluid source 130 into the fluid treatment system 128 to convert the second fluid 86 into a flush fluid 180. Once formed, the flush fluid 180 may then be pumped into the rotary IPX 40 to remove of particulate or highly viscous fluid in the gaps 112, 114, and 116.

In some embodiments, the frac system 10 may include a controller 130 with a processor 132 and a memory 134 that stores instructions executable by the processor 132 for controlling the valves 136, 138, and 140 (e.g., electronic actuators that open and close the valves); the pump 18, 20, and 122; and the fluid treatment system 128. In operation, the controller 130 communicates with the valves 136, 138, and 140 enabling selective use of the first fluid 88 and/or the fluid 123 for flushing the rotary IPX 40. For example, during startup, the controller 130 may open the valve 140, thus enabling the high-pressure pump 122 to flush the rotary IPX 40 with only the fluid 123. After flushing the rotary IPX 40, the controller 130 may start closing the valve 140 and start normal operations of the rotary IPX 40 (e.g., pressure exchange between the first and second fluids 88, 86). In other words, the controller 130 may start operation of the rotary IPX 40 with the flush fluid 180 and then gradually transition from flushing the rotary IPX 40 to steady state operations with the first and second fluids 88, 86. In some embodiments, the controller 130 may stop all flushing before beginning steady state operations with the first and second fluids 88, 86.

During steady state operations, the controller 130 may receive input from sensors 190, 192, and 194 that monitor operation of the rotary IPX 40. These sensors 190, 192, and 194 may include a rotational speed sensors, pressure sensors, flow rate sensors, acoustic sensors, etc. For example, the sensor 192 may be a rotational speed sensor (e.g., visual or optic, magnetic, acoustic, etc.) that detects the rotational speed of the rotor 46 enabling the controller 130 to monitor whether the rotary IPX 40 is slowing or stalled. In some embodiments, the sensor 192 may be an acoustic sensor that detects vibration or noise associated with proper operation (e.g., proper rotational speeds of the rotor 46), enabling the controller 130 to monitor whether the rotary IPX 40 is slowing or stalled. The sensors 190 and 194 may likewise be flow rate sensors, acoustic sensors, or flow composition sensors that enable the controller 130 to monitor operation of the rotary IPX 40. For example, flow composition sensors 190, 194 may detect a stalled rotor 46 by detecting increased particulate flowing through the outlet 78 or an absence of particulate flowing through the outlet 80, which indicates the rotor 46 has stalled and the first and second fluids 88, 86 are flowing through the rotor 46 without exchanging pressure. Similarly, acoustic sensors 190, 194 may detect additional noise from particulate flowing through the outlet 78 or reduced noise through the outlet 80, indicating that the rotor 46 has stalled. If the controller 130 detects a stalled or slowing rotor 46, the controller 130 may open or partially open the valves 136, 138, and/or 140 to flush the rotary IPX 40. For example, the controller 130 may pump the flush fluid 180 into the rotary IPX 40 while the rotary IPX 40 operates (e.g., exchanges pressure between the first and second fluids 88, 86). As the flush fluid 180 flows through the rotary IPX 40, the flush fluid 180 removes particulate, sediment, etc. from the gaps 112, 114, and 116, and the controller 130 may continue to monitor operation of the rotary IPX 40 with the sensors 190, 192, and/or 194. If the controller 130 determines the rotor 46 is still not rotating properly or returning to a proper operating condition, the controller 130 may keep the valves 136, 138, and/or 140 open while stopping operation of the pump 20 (e.g., the pump pumping highly viscous or particulate laden fluid) in order to completely flush the rotary IPX 40. After flushing the rotary IPX 40, the controller 130 may again turn on the pump 20, returning the rotary IPX 40 to steady state operating conditions. Before shutdown of the frac system 10, the frac system 10 may also use the flush system 178 to flush the rotary IPX 40 in preparation for the future operations. Accordingly, the flush system 178 may be used before, during, and after operation of the frac system 10 to improve the efficiency and operation of the rotary IPX 40.

As illustrated, the flush system 178 may pump flush fluid 180 through one or more apertures 144 (e.g., 1, 2, 3, 4, 5, or more) in the casing 120. These apertures 144 may be positioned at different positions along the axis and circumference of the rotary IPX 40. For example, the casing 120 may have an aperture 144 axially positioned between the first end cover 64 and the rotor 46; another aperture 144 through the casing 120 and the rotor sleeve 44; and/or aperture 144 axially positioned between the rotor 46 and the second end cover 66. In this manner, the flush system 178 is able to concentrate flush fluid 180 into the gaps 112, 114, and 116 to remove particulate and/or highly viscous fluid.

Figure 9:
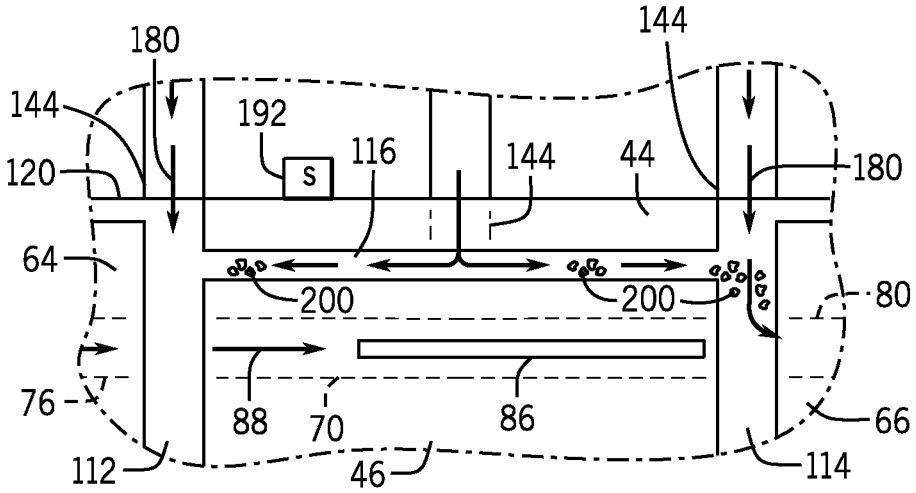
FIG. 9 is a partial cross-sectional view of an embodiment of a rotor IPX within line 9-9 of FIG. 8.

FIG. 9 is a sectional view along line 9-9 of the rotary IPX in FIG. 8. As illustrated, the apertures 144 enable flush fluid 180 to pass through the casing 120 and into the rotary IPX 40. As the flush fluid 180 enters the rotary IPX 40, the flush fluid 180 flows through the gaps 112, 114, and 116 dislodging particulate 200, breaking up deposited sediment 200, etc. enabling efficient operation of the rotary IPX.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a frac system, comprising:

a rotary isobaric pressure exchanger configured to exchange pressures between a first fluid and a second fluid; and a lubrication system configured to lubricate the rotary isobaric pressure exchanger, wherein the lubrication system comprises a pump configured to pump a third fluid into the rotary isobaric pressure exchanger to lubricate the rotary isobaric pressure exchanger.

2. The system of claim 1, wherein the first fluid is a substantially particulate free fluid and the second fluid is a particulate laden fluid.

3. The system of claim 1, wherein the first fluid and the third fluid are the same.

4. The system of claim 1, wherein the lubrication system comprises a filter.

5. The system of claim 4, wherein the rotary isobaric pressure exchanger comprises a rotor, a sleeve surrounding the rotor, a first end cap, and a second end cap.

6. The system of claim 5, wherein the lubrication system is configured to pump the third fluid into a gap between the sleeve and the rotor.

7. The system of claim 1, wherein the lubrication system comprises a fluid treatment system configured to convert the first or second fluid into the third fluid.

8. The system of claim 1, wherein the frac system comprises a controller that controls the flow of the third fluid of the lubrication system into the rotary isobaric pressure exchanger.

9. The system of claim 6, wherein the controller communicates with a first sensor configured to detect whether the rotor is rotating with a speed within a threshold range.

10. A method, comprising:

monitoring rotation of a rotor in a rotary isobaric pressure exchanger, wherein the rotary isobaric pressure exchanger exchanges pressure between a first fluid and a second fluid; and detecting a condition when the rotor is rotating with a speed outside of a threshold range; and lubricating the rotary isobaric pressure exchanger with a lubrication fluid in response to the condition by pumping a third fluid through the rotary isobaric pressure exchanger.

11. The method of claim 10, wherein monitoring rotation of the rotor comprises monitoring an acoustic sensor, an optical sensor, or a pressure sensor with a controller.

12. The method of claim 10, comprising controlling a pump to pump the third fluid through the rotary isobaric pressure exchanger in response to the condition.

13. The method of claim 10, comprising controlling a fluid treatment system to treat the third fluid prior to lubricating the rotary isobaric pressure exchanger.

14. The method of claim 10, comprising controlling a pump to pump the third fluid through the rotary isobaric pressure exchanger while operating a frac system coupled to the rotary isobaric pressure exchanger.

15. A system, comprising:

a frac system, comprising:

a rotary isobaric pressure exchanger configured to exchange pressures between a first fluid and a second fluid;

a lubrication system configured to lubricate the rotary isobaric pressure exchanger; and a controller that controls the flow of a third fluid of the lubrication system into the rotary isobaric pressure exchanger.

* * * * *